US009261102B2

(12) United States Patent
Gingter et al.

(10) Patent No.: US 9,261,102 B2
(45) Date of Patent: Feb. 16, 2016

(54) COMPRESSOR ARRANGEMENT

(75) Inventors: Philipp Gingter, Mönchengladbach (DE); Dieter Weckmüller, Oberhausen (DE); Karl-Heinz Dreyer, Wesel (DE)

(73) Assignee: MAN Diesel & Turbo SE, Augsburg (DE)

( * ) Notice: Subject to any disclaimer, the term of this patent is extended or adjusted under 35 U.S.C. 154(b) by 523 days.

(21) Appl. No.: 13/263,086

(22) PCT Filed: Jan. 11, 2010

(86) PCT No.: PCT/DE2010/050000

§ 371 (c)(1), (2), (4) Date: Dec. 23, 2011

(87) PCT Pub. No.: WO2010/115420

PCT Pub. Date: Oct. 14, 2010

(65) Prior Publication Data

US 2012/0189431 A1 Jul. 26, 2012

(30) Foreign Application Priority Data

Apr. 7, 2009 (DE) ..... 10 2009 016 392

(51) Int. Cl.
*F04D 25/16* (2006.01)
*F04D 17/12* (2006.01)
(Continued)

(52) U.S. Cl.
CPC ..... *F04D 25/16* (2013.01); *F04D 17/12* (2013.01); *F04D 19/02* (2013.01); *F04D 27/0246* (2013.01); *F04D 29/701* (2013.01)

(58) Field of Classification Search
CPC ..... F04D 17/12; F04D 17/122; F04D 19/02; F04D 27/0269; F04D 27/0246; F04D 25/16; F04D 29/701; F04D 29/706
USPC ..... 415/149.1, 55.6, 55.7, 60, 61, 62, 143; 416/130, 120; 417/246, 426, 429
See application file for complete search history.

(56) References Cited

U.S. PATENT DOCUMENTS 1,519,449 A * 12/1924 Graemiger ..... 417/245
2,350,839 A * 6/1944 Szydlowski ..... F04D 17/00 415/143

(Continued)

FOREIGN PATENT DOCUMENTS

| | | |
|---|---|---|
| CH | 234 199 | 9/1944 |
| CH | 695 869 | 9/2006 |
| CN | 1639466 | 10/1914 |
| CN | 101002025 | 7/2007 |
| DE | 547 354 | 3/1932 |
| DE | 1 628 242 | 4/1971 |

(Continued)

OTHER PUBLICATIONS

Office Action dated Apr. 16, 2014 issued in the corresponding Japanese Patent Application No. 2012-503864.

*Primary Examiner* — Igor Kershteyn
*Assistant Examiner* — Woody A Lee, Jr.
(74) *Attorney, Agent, or Firm* — Cozen O'Connor

(57) ABSTRACT

Compressor arrangement having an axial compressor and a radial compressor which are arranged axially one behind the other on a common driveshaft which can be coupled to a drive and which each have a compression fluid input and a compression fluid output. The axial compressor is provided with first control elements and the radial compressor is provided with second control elements. The first control elements and second control elements are controllable separately so that the axial compressor and the radial compressor are controllable separately.

13 Claims, 2 Drawing Sheets

(51) Int. Cl.

| | |
|---|---|
| ***F04D 19/02*** | (2006.01) |
| ***F04D 27/02*** | (2006.01) |
| ***F04D 29/70*** | (2006.01) |

(56) References Cited

U.S. PATENT DOCUMENTS

| | | | | |
|---|---|---|---|---|
| 3,421,685 | A * | 1/1969 | Anderson et al. | 415/10 |
| 5,980,218 | A | 11/1999 | Takahashi et al. | |
| 7,240,515 | B2 * | 7/2007 | Conry | 62/510 |
| 7,921,646 | B2 * | 4/2011 | Swenson et al. | 60/605.1 |
| 2009/0136335 | A1 * | 5/2009 | Nakazeki et al. | 415/13 |
| 2010/0098525 | A1 * | 4/2010 | Guelich | 415/13 |

FOREIGN PATENT DOCUMENTS

| | | | | |
|---|---|---|---|---|
| DE | 1 959 754 | | 6/1971 | |
| GB | 580458 | | 9/1946 | |
| GB | 580458 | A * | 9/1946 | F04D 29/58 |
| GB | 2 138 553 | | 10/1984 | |
| JP | 31-2438 | | 6/1943 | |
| JP | 62-82382 | | 5/1987 | |
| JP | 10-89296 | | 4/1998 | |
| JP | 2005-519214 | | 6/2005 | |
| JP | 2007-024005 | | 2/2007 | |
| WO | WO 03/072946 | | 9/2003 | |
| WO | WO 2010/115420 | | 10/2010 | |

* cited by examiner

COMPRESSOR ARRANGEMENT

CROSS REFERENCE TO RELATED APPLICATIONS

This is a U.S. national stage of application No. PCT/DE2010/050000, filed on Jan. 11, 2010. Priority is claimed on German Application No.: 10 2009 016 392.1, filed Apr. 7, 2009. The contents of which are incorporated here by reference.

BACKGROUND OF THE INVENTION

1. Field of the Invention

The invention is directed to a compressor arrangement having an axial compressor and a radial compressor.

2. Detail Description of Prior Art

A combined axial/radial turbine is known from DE 547 354 C.

A compressor installation comprising a four-stage transmission turbo compressor preceded by an axial compressor is known from DE 1 628 242 A1.

A multistage transmission turbo compressor having interstage cooling and comprising axial and radial stages is known from DE 1 959 754 A1.

SUMMARY OF THE INVENTION

An object of the invention is to provide a compact compressor arrangement having an axial compressor and a radial compressor, wherein the axial compressor and radial compressor can meet the requirements of different processes.

According to one embodiment of the invention, a compressor arrangement having an axial compressor and a radial compressor is provided, wherein the axial compressor and the radial compressor are arranged one behind the other on a common driveshaft which can be coupled to a drive and which each have a compression fluid input and a compression fluid output, the axial compressor is provided with a first controller and the radial compressor is provided with a second controller, and the first controller and second control means are controllable separately so that the axial compressor and the radial compressor are controllable separately.

The solution according to one embodiment of the invention provides a compact compressor arrangement having an axial compressor and a radial compressor, wherein the axial compressor and the radial compressor can meet the requirements of different processes. This is achieved in particular in that the axial compressor and radial compressor are arranged on a common driveshaft and are each provided with separately controllable controller.

According to an embodiment form of the invention, the second controller has inlet guide vanes arranged at the compression fluid input of the radial compressor in front of a first rotor of the radial compressor.

According to an embodiment form of the invention, the axial compressor and the radial compressor have a housing common to both, wherein seals are provided so that compression fluid is prevented from passing between the axial compressor and the radial compressor in the housing. Moisture is prevented from passing from the axial compressor to the radial compressor preferably by seals.

A separate radial compressor housing and additional components (such as, e.g., intermediate transmissions and couplings) which would be necessary for connecting two separate compressor housings in a train can be dispensed with owing to the common housing. As a result, the entire train and the compressor arrangement according to the invention can be provided at optimized cost.

According to an embodiment form of the invention, the axial compressor is configured to compress a fluid mass flow supplied to the compression fluid input of the axial compressor at a first pressure value to a fluid mass flow which can be tapped at the compression fluid output of the axial compressor at a second pressure value which is increased over the first pressure value, wherein the radial compressor is configured to compress a fluid mass flow supplied to the compression fluid input of the radial compressor at a third pressure value to a fluid mass flow which can be tapped at the compression fluid output of the radial compressor and which has a fourth pressure value which is increased over the second pressure value and the third pressure value.

According to an embodiment form of the invention, the radial compressor is configured to receive via its compression fluid input approximately 30 percent of the fluid mass flow issuing from the compression fluid output of the axial compressor.

According to an embodiment form of the invention, the first pressure value is approximately 1 bar and the second pressure value is approximately 3.2 bar.

According to an embodiment of the invention, the third pressure value is approximately equal to the second pressure value.

According to an embodiment form of the invention, the third pressure value is approximately 3 bar.

According to an embodiment form of the invention, the fourth pressure value is approximately 5 bar.

According to an embodiment form of the invention, the compressor arrangement further has a fluid dehumidification device having a first fluid input, a second fluid input and a fluid output and which is configured to dehumidify a fluid mass flow supplied to it via the first fluid input, wherein the first fluid input of the fluid dehumidification device is fluidically connected to the compression fluid output of the axial compressor, and wherein the fluid output of the fluid dehumidification device is fluidically connected to the compression fluid input of the radial compressor.

According to an embodiment form of the invention, the fluid dehumidification device is configured to divide the fluid mass flow supplied to it via the first fluid input in such a way that approximately 30 percent of the fluid mass flow supplied to it via the first fluid input can be tapped at its fluid output as completely dehumidified fluid mass flow.

According to an embodiment form of the invention, the second fluid input of the fluid dehumidification device is fluidically connected to the compression fluid output of the radial compressor.

Finally, according to an embodiment form of the invention, the radial compressor is outfitted with inlet guide vanes in front of the first radial rotor, and the axial compressor and radial compressor are regulated separately so that both can accommodate different processes. According to an embodiment form of the invention, the axial compressor is used as a main air compressor (MAC) in that the axial compressor compresses filtered ambient air, and the radial compressor is used as a booster air compressor (BAC) which compresses completely dried air. The mass flows or volume flows of the axial compressor and radial compressor differ significantly and, according to an embodiment form of the invention, the fluid mass flow of the radial compressor is one third or 30 percent of the fluid mass flow of the axial compressor. According to an embodiment form of the invention, it is further ensured that no moisture from the axial compressor arrives in the radial compressor. Further, according to an embodiment form of the invention, a separate radial compressor housing and additional components (e.g., intermediate transmissions and couplings) which would be needed to connect two separate compressor housings in a train are obviated. Finally, the entire train and the compressor arrangement according to the invention are provided at optimized cost.

In constructions not yet claimed heretofore, the axial compressor and the radial compressor can be arranged on a common driveshaft in the compressor arrangement.

The driveshaft can have two bearings arranged substantially at the ends.

Alternatively, the driveshaft can have no bearings between the axial compressor and radial compressor.

The driveshaft can be constructed as a rigid rotor. The driveshaft can be constructed as a welded or flanged connection.

The drive can be a steam turbine, a gas turbine, an expander, a combustion engine, or an electric motor. The drive can have a transmission. The drive can have a clutch arrangement.

The controller can be a guide vane adjustment device, a throttle arrangement or a rotational speed control.

The controller of the radial compressor can have inlet guide vanes which are arranged at the compression fluid input of the radial compressor in front of a first rotor of the radial compressor.

The axial compressor and the radial compressor can have a housing common to both. Sealing means are provided so as to substantially prevent compression fluid from passing between the axial compressor and radial compressor in the housing.

BRIEF DESCRIPTION OF THE DRAWINGS

The invention will be described in more detail in the following based on a preferred embodiment form and with reference to the accompanying drawings.

DETAILED DESCRIPTION OF THE PREFERRED EMBODIMENTS

Figure 1:
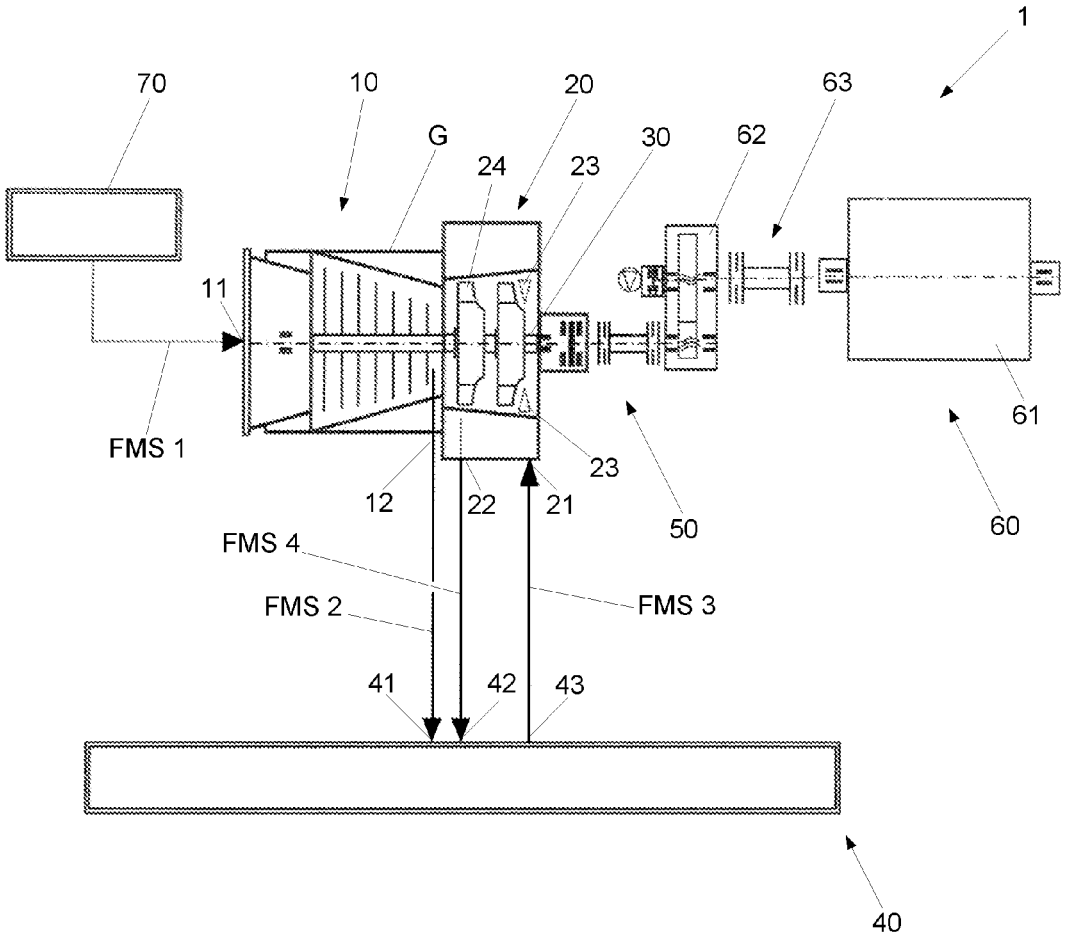
FIG. 1 shows a schematic view of a compressor arrangement according to an embodiment form of the invention.
Figure 2:
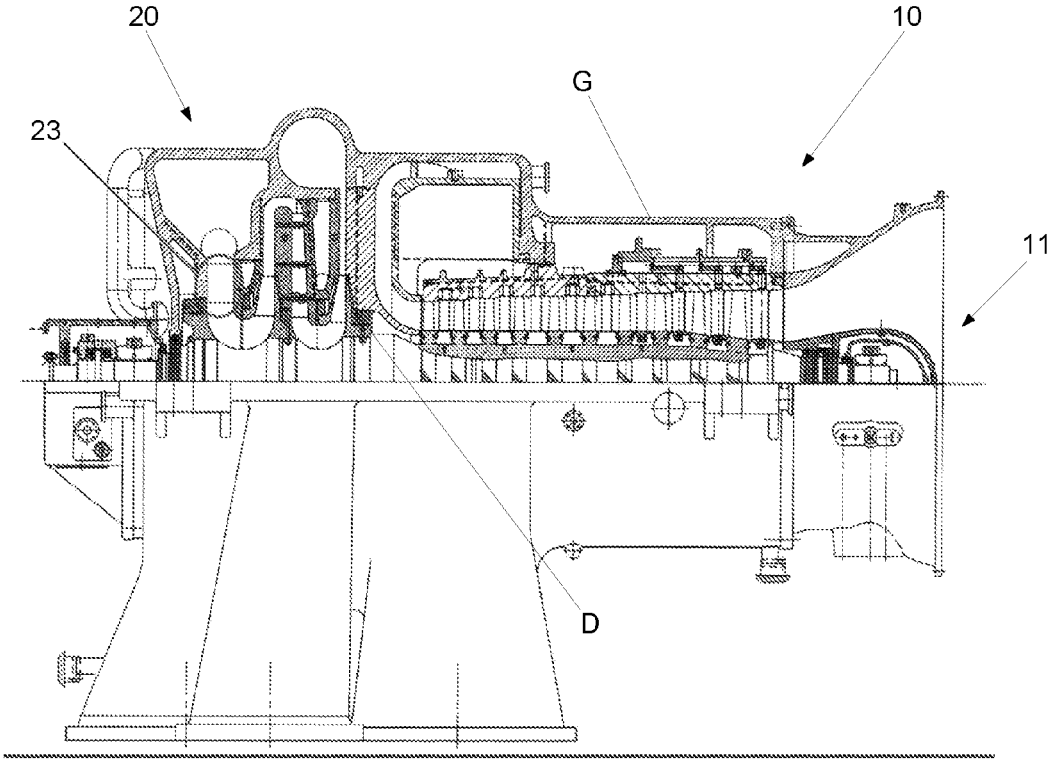
FIG. 2 shows a schematic sectional view of the axial compressor and radial compressor of the compressor arrangement of FIG. 1.

FIGS. 1 and 2 show a compressor arrangement 1 having an axial compressor 10 and a radial compressor 20, which are arranged axially one behind the other on a common driveshaft 30, and a fluid dehumidification device 40.

The driveshaft 30 can be selectively drivingly coupled to a drive 60 via a clutch arrangement 50. The drive 60 has an electric motor 61, a transmission 62, and a clutch arrangement 63 by which the electric motor 61 is drivingly coupled to the transmission 62.

The axial compressor 10 has a compression fluid input 11 and a compression fluid output 12. The radial compressor 20 has a compression fluid input 21 and a compression fluid output 22.

The fluid dehumidification device 40 has a first fluid input 41, a second fluid input 42 and a fluid output 43. The fluid dehumidification device 40 is configured to dehumidify a fluid mass flow supplied to it via the first fluid input 41 and to divide the fluid mass flow supplied to it via the first fluid input 41 in such a way that approximately 30 percent of the fluid mass flow supplied to it via the first fluid input 41 can be tapped at its fluid output 42 as completely dehumidified fluid mass flow.

The first fluid input 41 of the fluid dehumidification device 40 is fluidically connected to the compression fluid output 12 of the axial compressor 10, the second fluid input 42 of the fluid dehumidification device 40 is fluidically connected to the compression fluid output 22 of the radial compressor 20, and fluid output 43 of the fluid dehumidification device 40 is fluidically connected to the compression fluid input 21 of the radial compressor 20.

The compression fluid input 11 of the axial compressor 10 can be supplied via a filter installation 70 with ambient air of a determined humidity as compression fluid. However, any compressible fluid can be used as compression fluid.

The axial compressor 10 is provided with first control elements having adjustable guide vanes. The radial compressor 20 is provided with second control elements having adjustable inlet guide vanes 23 which are arranged at the compression fluid input 21 of the radial compressor 20 in front of a first rotor 24 of the radial compressor 20.

The first control elements and second control elements are controllable separately by actuators so that the axial compressor 10 and the radial compressor 20 can be controlled separately particularly with respect to the fluid mass flow transported in each instance and the respective degree of compression.

As can be seen particularly from FIG. 2, the axial compressor 10 and the radial compressor 20 have a housing G common to both, wherein seals D are provided so that compression fluid is prevented from passing between the axial compressor 10 and the radial compressor 20 in the housing G. More precisely stated, humid air is prevented from flowing out of the axial compressor into the radial compressor by the seals according to an embodiment form of the invention.

The axial compressor 10 is configured to compress a fluid mass flow FMS1 supplied to the compression fluid input 11 of the axial compressor 10 from the filter installation 70 at a first pressure value to a fluid mass flow FMS2 which can be tapped at the compression fluid output 12 of the axial compressor 10 at a second pressure value which is increased over the first pressure value. The fluid mass flow FMS2 which can be tapped at the compression fluid output 12 of the axial compressor 10 is supplied to the first fluid input 41 of the fluid dehumidification device 40. According to an embodiment of the invention, the first pressure value is approximately 1 bar and the second pressure value is approximately 3.2 bar.

The fluid dehumidification device 40, which is constructed according to an embodiment form of the invention as an air separation installation for generating oxygen with a low level of purity, divides the fluid mass flow FMS2 supplied to its via the first fluid input 41 from the axial compressor 10 in such a way that approximately 30 percent of the fluid mass flow FMS2 supplied to the fluid dehumidification device 40 from the axial compressor 10 via the first fluid input 41 can be tapped at the fluid output 43 of the fluid dehumidification device 40 as a completely dehumidified fluid mass flow FMS3 having a third pressure value.

The completely dehumidified fluid mass flow FMS3 is supplied to the compression fluid input 21 of the radial compressor 20 from the fluid output 43.

According to embodiment forms of the invention, the third pressure value is approximately equal to the second pressure value and in particular is approximately 3 bar.

The radial compressor 20 is configured to receive the approximately 30 percent of the fluid mass flow FMS2 issuing from the compression fluid output 12 of the axial compressor 10 via its compression fluid input 21 and the fluid mass flow FMS3 supplied from the fluid output 43 of the fluid dehumidification device 40.

Further, the radial compressor 20 is configured to compress the fluid mass flow FMS3 supplied to the compression fluid input 21 of the radial compressor 20 at the third pressure value to a completely dry fluid mass flow FMS4 which can be tapped at the compression fluid output 22 of the radial compressor 20 at a fourth pressure value which is increased over the second pressure value and third pressure value.

According to an embodiment form of the invention, the fourth pressure value is approximately 5 bar.

It should be noted that the first to fourth pressure values can be higher or lower according to further embodiment forms of the invention.

The completely dry fluid mass flow FMS4 which can be tapped at the compression fluid output 22 of the radial compressor 20 is then supplied to the fluid dehumidification device 40 again via its second fluid input 42.

Finally, according to an embodiment form of the invention, the radial compressor 10 is outfitted with inlet guide vanes 23 in front of the first radial rotor 24, and the axial compressor 10 and radial compressor 20 are regulated separately as individual compressors of a compression train so that both can accommodate different processes. According to an embodiment of the invention, the axial compressor 10 is used as a main air compressor (MAC) in that the axial compressor 10 compresses ambient air which is filtered by means of the filter installation 70. The radial compressor 20 is used as a booster air compressor (BAC) which compresses completely dried air.

The mass flows or volume flows of the axial compressor 10 and radial compressor 20 differ significantly. According to an embodiment form of the invention, the fluid mass flow FMS3 or FMS4 of the radial compressor 20 is one third or 30 percent of the fluid mass flow FMS1 or FMS2 (100 percent) of the axial compressor 10. According to an embodiment form of the invention, it is further ensured by the seals D that no moisture from the axial compressor 10 reaches the radial compressor 20.

According to an embodiment form of the invention, the axial compressor 10 and the radial compressor 20 have a housing G common to both so as to obviate a separate housing for the radial compressor 20 and additional components (e.g., intermediate transmissions and couplings) which would be necessary for connecting two separate compressor housings in a compression train. Finally, the entire compression train and the compressor arrangement 1 according to the invention are provided at optimized cost.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A compressor arrangement comprising:

an axial compressor having a first compression fluid input and a first compression fluid output;

a radial compressor having a second compression fluid input and a second compression fluid output;

a common driveshaft coupleable to a drive on which the axial compressor and the radial compressor are arranged axially one behind the other;

a first control element of the axial compressor comprising adjustable guide vanes; and a second control element of the radial compressor comprising inlet guide vanes arranged at the second compression fluid input of the radial compressor in front of a first rotor of the radial compressor, wherein the first control element and the second control element are separately controllable so that the axial compressor and the radial compressor are controllable separately.

2. The compressor arrangement according to claim 1, wherein the axial compressor and the radial compressor have a housing common to both, and sealing elements arranged so that compression fluid is prevented from passing between the axial compressor and the radial compressor in the housing.

3. The compressor arrangement according to claim 2, wherein the axial compressor compresses a first fluid mass flow supplied to the first compression fluid input at a first pressure value to a second fluid mass flow tapped at the first compression fluid output of the axial compressor at a second pressure value which is increased over the first pressure value, wherein the radial compressor is configured to compress a third fluid mass flow supplied to the second compression fluid input at a third pressure value to a fourth fluid mass flow tapped at the second compression fluid output of the radial compressor and which has a fourth pressure value which is increased over the second pressure value and the third pressure value.

4. The compressor arrangement according to claim 3, wherein the radial compressor is configured to receive via its second compression fluid input approximately 30 percent of the fluid mass flow issuing from the first compression fluid output of the axial compressor.

5. The compressor arrangement according to claim 4, wherein the first pressure value is substantially 1 bar and the second pressure value is substantially 3.2 bar.

6. The compressor arrangement according to claim 3, wherein the third pressure value is substantially equal to the second pressure value.

7. The compressor arrangement according to claim 6, wherein the third pressure value is substantially 3 bar.

8. The compressor arrangement according to claim 7, wherein the fourth pressure value is substantially 5 bar.

9. The compressor arrangement according to claim 7, further comprising a fluid dehumidification device which has a first fluid input, a second fluid input and a fluid output and which is configured to dehumidify a fluid mass flow supplied to it via the first fluid input, wherein the first fluid input of the fluid dehumidification device is fluidically connected to the first compression fluid output of the axial compressor, and wherein the fluid output of the fluid dehumidification device is fluidically connected to the second compression fluid input of the radial compressor.

10. The compressor arrangement according to claim 3, further comprising a fluid dehumidification device which has a first fluid input, a second fluid input and a fluid output and which is configured to dehumidify a fluid mass flow supplied to it via the first fluid input, wherein the first fluid input of the fluid dehumidification device is fluidically connected to the first compression fluid output of the axial compressor, and wherein the fluid output of the fluid dehumidification device is fluidically connected to the second compression fluid input of the radial compressor.

11. The compressor arrangement according to claim 10, wherein the fluid dehumidification device divides the fluid mass flow supplied to it via the first fluid input such that substantially 30 percent of the fluid mass flow supplied to it via the first fluid input tapped at its fluid output as dehumidified fluid mass flow.

12. The compressor arrangement according to claim 11, wherein the second fluid input of the fluid dehumidification device is fluidically connected to the second compression fluid output of the radial compressor.

13. The compressor arrangement according to claim 1, wherein the first control element comprises inlet guide vanes arranged at the first compression fluid input of the axial compressor.

* * * * *